US010421301B2

(12) United States Patent
Taketsugu et al.

(10) Patent No.: US 10,421,301 B2
(45) Date of Patent: Sep. 24, 2019

(54) RECORDING APPARATUS

(71) Applicant: SEIKO EPSON CORPORATION, Tokyo (JP)

(72) Inventors: Eiji Taketsugu, Matsumoto (JP); Toshio Miyake, Shiojiri (JP); Hisayuki Akahane, Matsumoto (JP); Masachika Nagase, Fujimi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/710,653

(22) Filed: Sep. 20, 2017

(65) Prior Publication Data

US 2018/0093511 A1 Apr. 5, 2018

(30) Foreign Application Priority Data

Sep. 30, 2016 (JP) ..... 2016-194214

(51) Int. Cl.
*B41J 29/13* (2006.01)
*B41J 29/54* (2006.01)
*B41J 29/02* (2006.01)

(52) U.S. Cl.
CPC ..... *B41J 29/13* (2013.01); *B41J 29/02* (2013.01); *B41J 29/54* (2013.01)

(58) Field of Classification Search
CPC combination set(s) only.
See application file for complete search history.

(56) References Cited

U.S. PATENT DOCUMENTS 5,105,210 A * 4/1992 Hirano ..... B41J 3/37 346/104
5,913,182 A * 6/1999 Inoue ..... B41L 31/00 242/534
7,551,332 B2 * 6/2009 Itoi ..... H04N 1/1017 355/25
7,722,033 B2 * 5/2010 Matsumoto ..... B65H 1/02 271/145
7,798,407 B2 * 9/2010 Hall, Jr. ..... H04N 1/00002 235/406
8,081,352 B2 * 12/2011 Ogushi ..... H04N 1/00519 355/128
8,210,516 B2 * 7/2012 Acton ..... B41J 13/025 271/3.14

(Continued)

FOREIGN PATENT DOCUMENTS

JP 2015-202615 A 11/2015

OTHER PUBLICATIONS iP3600_Canon-2008.*

*Primary Examiner* — John Zimmermann
(74) *Attorney, Agent, or Firm* — Workman Nydegger

(57) ABSTRACT

A printer includes a first upper face cover and a second upper face cover. The first upper face cover is formed such that when a medium is set in a setting port, the width direction of the medium is a first direction, and the first upper face cover has a smaller dimension in the first direction than a dimension of an apparatus main body in the first direction. The first upper face cover in a closed state is included inside the second upper face cover in plan view when the second upper face cover is in a closed state. The first upper face cover and the second upper face cover both in the closed states form a shape that corresponds to an outline of an upper portion of the apparatus main body.

11 Claims, 15 Drawing Sheets

(56) References Cited

U.S. PATENT DOCUMENTS

| | | | | |
|---|---|---|---|---|
| 8,564,852 | B2 * | 10/2013 | Oshima | H04N 1/00543 358/474 |
| 9,731,528 | B2 * | 8/2017 | Akahane | B41J 29/02 |
| 2004/0017459 | A1 * | 1/2004 | Kawaguchi | B41J 3/4071 347/104 |
| 2006/0083564 | A1 * | 4/2006 | Yazawa | B41J 29/023 399/363 |
| 2006/0085946 | A1 * | 4/2006 | Hattori | H04N 1/00519 16/221 |
| 2008/0044197 | A1 * | 2/2008 | Muraki | G03G 15/5016 399/81 |
| 2010/0053701 | A1 * | 3/2010 | Yoshida | H04N 1/00525 358/474 |
| 2010/0060948 | A1 * | 3/2010 | Yoshida | H04N 1/00519 358/474 |
| 2010/0066796 | A1 * | 3/2010 | Yanagi | B41J 29/13 347/108 |
| 2011/0222948 | A1 * | 9/2011 | Asada | B41J 3/4073 400/611 |
| 2015/0294195 | A1 | 10/2015 | Shirota et al. | |
| 2016/0257146 | A1 * | 9/2016 | Akahane | B41J 29/02 |

* cited by examiner

RECORDING APPARATUS

BACKGROUND

1. Technical Field

The present invention is related to a recording apparatus that performs recording on a medium.

2. Related Art

Some recording apparatuses, which are typically printers, exist as a compact, lightweight, easy-to-carry mobile-type. In such recording apparatuses, an operation panel or the like is disposed with a setting port for a medium and operation buttons on an apparatus upper face, and an open/close body that opens and closes the apparatus upper face is provided. The open/close body forms in the open state a paper support that supports the medium set in the setting port, or the open/close body forms in the closed state a cover over the apparatus upper face in the closed state (for example, JP-A-2015-202615).

Mobile-type recording apparatuses are used not only indoors but also outdoors in many cases. Outdoor environments contain more dust and debris than indoor environments and are exposed to wind in some cases. This makes dust more liable to enter the interior of a recording apparatus, which may cause faults in the apparatus.

In recording apparatuses provided with the open/close body that opens and closes the apparatus upper face as in JP-A-2015-202615, the open/close body forms a cover over the entire apparatus upper face, including the setting port, to suppress the entry of dust when not in use. However, the entire apparatus upper face is opened up when in use (during recording), and thus there is a high concern of dust entering the interior of the recording apparatus.

SUMMARY

An advantage of some aspects of the invention is to suppress the entry of dust into the interior of a recording apparatus when the recording apparatus is in use.

A recording apparatus according to an aspect of the invention includes a setting port, a first open/close body, and a second open/close body. The setting port is to set a medium for feeding. The setting port is provided in an upper portion of an apparatus main body including a recording unit that performs recording on a medium. The first open/close body opens and closes a region of the upper portion of the apparatus main body that includes the setting port. The second open/close body opens and closes a region in the upper portion of the apparatus main body other than the region opened and closed by the first open/close body. Further, the first open/close body is formed such that when a medium is set in the setting port, the width direction of the medium is a first direction, and the first open/close body has a smaller dimension in the first direction than a dimension of the apparatus main body in the first direction. The first open/close body in a closed state is included inside the second open/close body in plan view when the second open/close body is in a closed state. The first open/close body and the second open/close body both in the closed states form a shape that corresponds to an outline of the upper portion of the apparatus main body.

According to this aspect, the first open/close body that opens and closes the region including the setting port is provided in the upper portion of the apparatus main body, and the second open/close body that opens and closes the region other than the region opened and closed by the first open/close body is provided in the upper portion of the apparatus main body. Further, the first open/close body and the second open/close body both in closed states form a shape that corresponds to the outline of the upper portion of the apparatus main body. This enables the first open/close body and the second open/close body to close and cover the upper portion of the apparatus main body when the recording apparatus is not in use, and enables the region of the upper portion of the apparatus main body where the setting port is included to be exposed by opening the first open/close body when the recording apparatus is in use (when recording). Namely, since only some, rather than the entirety, of the upper portion of the apparatus main body is exposed when the recording apparatus is in use, dust and the like entering the interior of the recording apparatus can be suppressed when in use.

In the recording apparatus according to the aspect of the invention, the first open/close body and the second open/close body have centers of rotation at an apparatus rear side and open and close in the same direction.

According to this aspect, the first open/close body and the second open/close body can both be placed in open states while saving space, since the first open/close body and the second open/close body include centers of rotation at the apparatus rear side and open and close in the same direction.

In the recording apparatus according to the aspect of the invention, the first open/close body includes an engaging portion that engages with the second open/close body, and the first open/close body opens when the second open/close body opens.

According to this aspect, the first open/close body can be opened and closed in coordination with opening and closing of the second open/close body.

In the recording apparatus according to the aspect of the invention, at least a portion of the engaging portion overlaps with the second open/close body in an apparatus height direction.

According to this aspect, since at least a portion of the engaging portion of the first open/close body overlaps with the second open/close body in the apparatus height direction, dust and liquid droplets entering through the engaging portion can be suppressed.

In the recording apparatus according to the aspect of the invention, the first open/close body is independently openable and closable when the second open/close body is in the closed state.

According to this aspect, since the first open/close body, which opens and closes a region that includes the setting port in the upper portion of the apparatus main body, is openable and closable independently from the second open/close body in the closed state, the first open/close body can be opened alone while the setting port is in use, namely, when the recording apparatus is in use, thus dust and the like entering the interior of the recording apparatus are suppressed when the recording apparatus is in use.

In the recording apparatus of the aspect of the invention, the first open/close body in the open state adopts an inclined orientation to support a medium to be set in the setting port.

According to this aspect, the medium to be set in the setting port can be supported by opening the first open/close body.

In the recording apparatus of the aspect of the invention, the second open/close body includes arm portions at both sides of the first open/close body in the first direction, and is rotatably joined to the apparatus main body through the arm portions.

This makes the configuration of the recording apparatus simple and achieve a pleasing external appearance.

In the recording apparatus according to the aspect of the invention, an operation section that receives an operation input is revealed together with the setting port by opening the first open/close body.

According to this aspect, since the operation section that receives an operation input can be revealed together with the setting port by opening the first open/close body, an operation input to the recording apparatus is enabled without opening the second open/close body when the first open/close body is opened to use the recording apparatus (to record).

In the recording apparatus according to the aspect of the invention, the apparatus main body includes an opening portion through which a movement region of a carriage provided with the recording unit is revealed by opening the second open/close body.

In the configuration where an entire upper portion of an apparatus main body including a setting port is opened and closed by a single open/close body as in the related art, an opening portion that uncovers a movement region of a carriage provided with a recording unit in the upper portion of the apparatus main body is covered by an opening/closing cover (the opening/closing cover 9 in JP-A-2015-202615 described above). The movement region of the carriage is uncovered when, for example, performing maintenance such as replacing ink tanks installed in the carriage.

In the invention, the second open/close body is not opened when the recording apparatus is in use. When the second open/close body is opened, the movement region of the carriage provided with the recording unit can be revealed. In other words, an opening that uncovers the movement region of the carriage so as to reveal the movement region is opened and closed by the second open/close body. This enables the number of components to be reduced.

In the recording apparatus of the aspect of the invention, the second open/close body includes a wall section and at least a portion of the wall section overlaps with the apparatus main body in the apparatus height direction.

According to this aspect, dust, liquid droplets, and the like entering the interior of the recording apparatus can be more effectively suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Exemplary Embodiment

First, an outline of a recording apparatus according to an exemplary embodiment of the invention is described. In the present exemplary embodiment, an ink jet printer 1 (simply referred to as the printer 1 hereafter) is given as an example of the recording apparatus.

Figure 1:
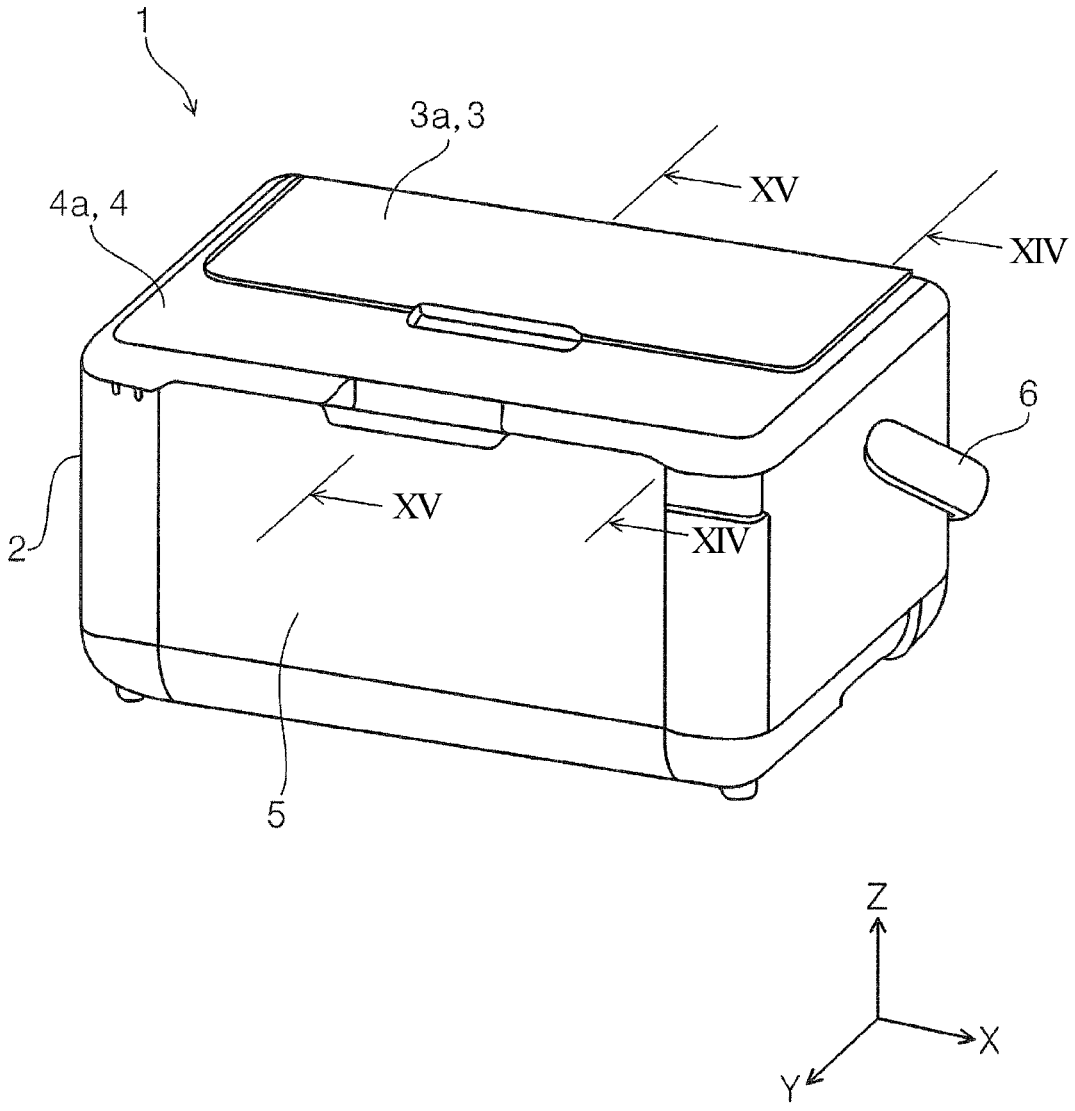
FIG. 1 is an exterior perspective view illustrating an example of a printer according to the invention.
Figure 2:
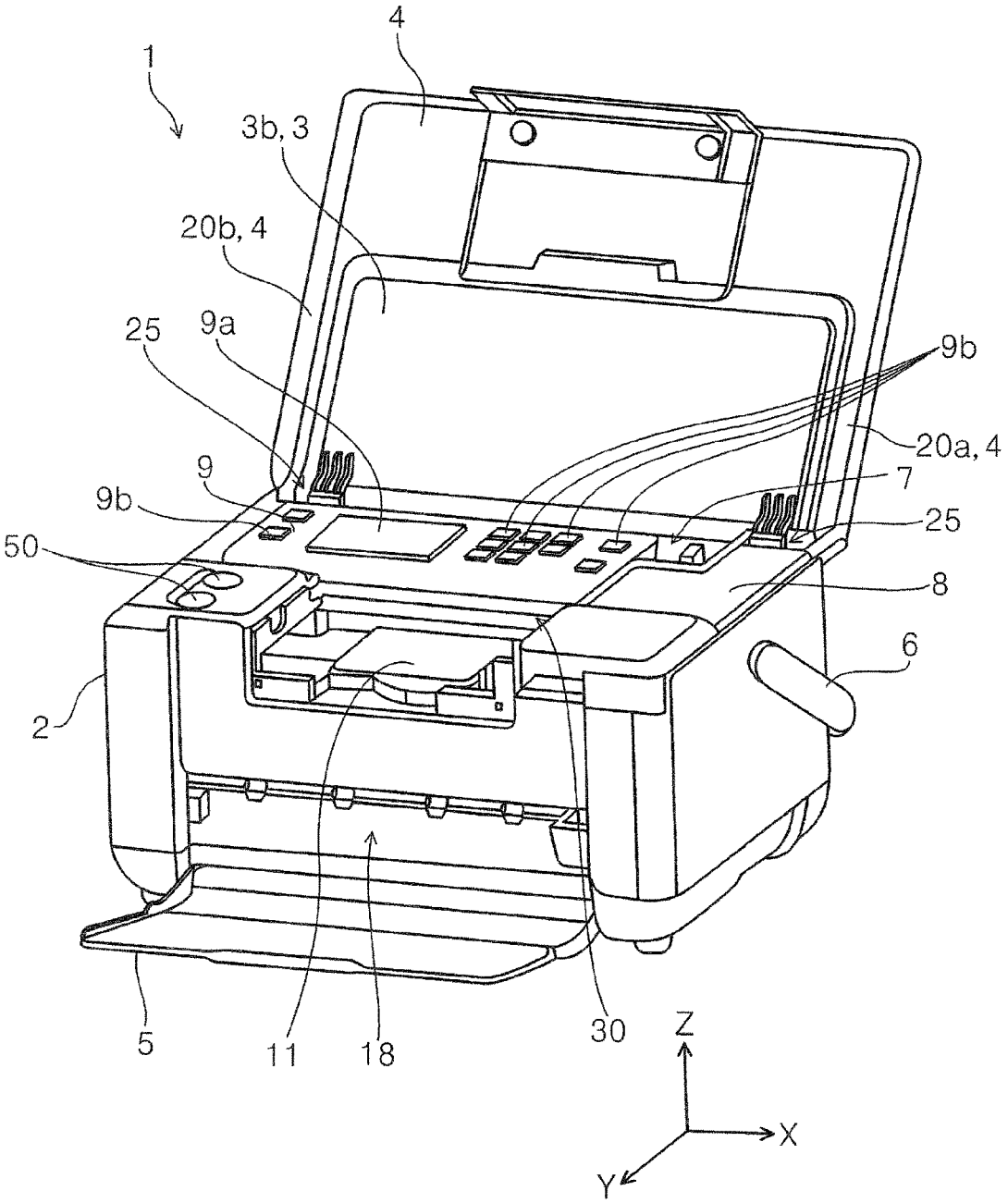
FIG. 2 is a perspective view illustrating a printer according to the invention in a state in which a first upper face cover, a second upper face cover, and a paper discharge cover are open.
Figure 3:
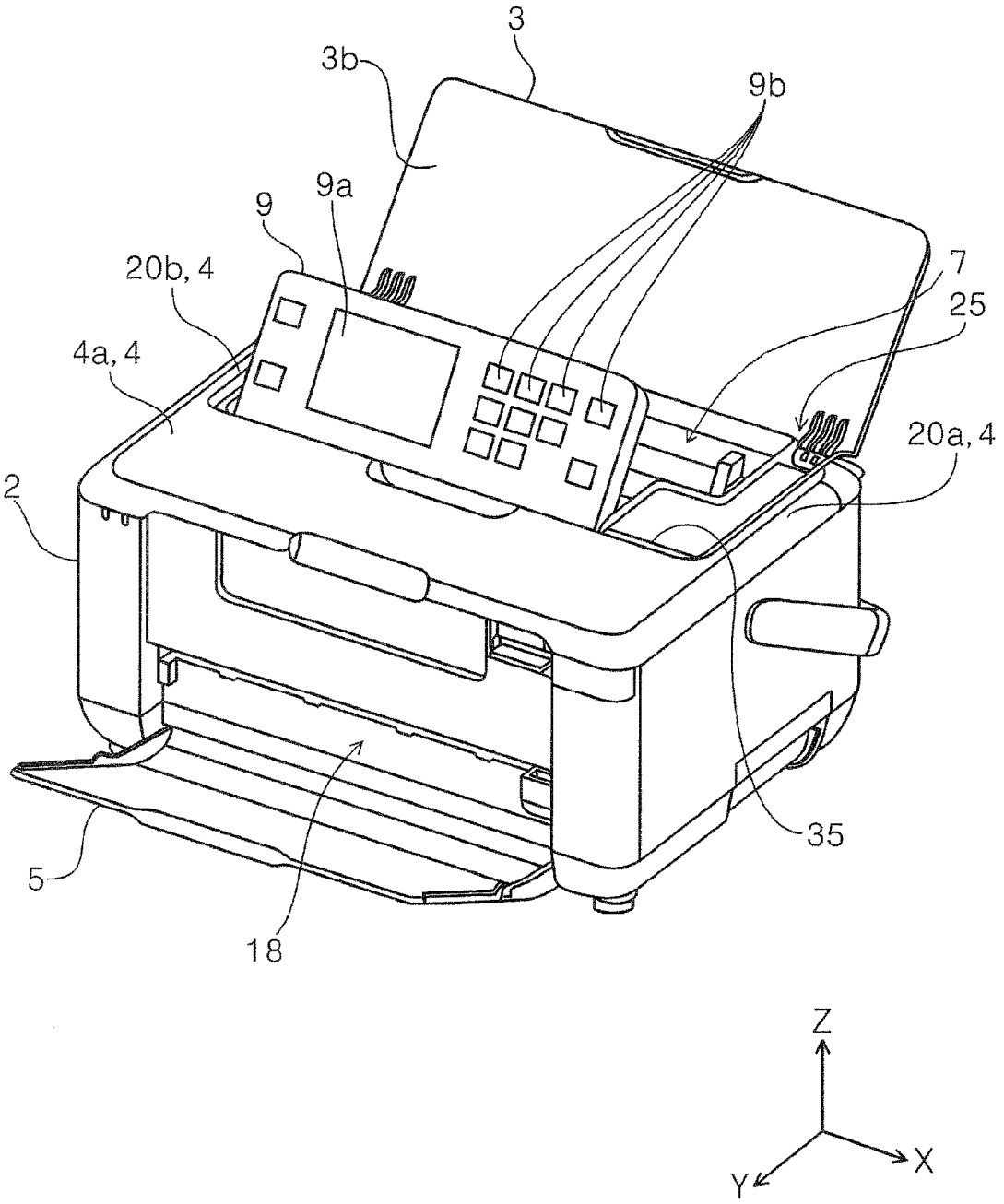
FIG. 3 is a perspective view illustrating a printer according to the invention in a state in which a first upper face cover and a paper discharge cover are open, and a panel unit is lifted up.
Figure 4:
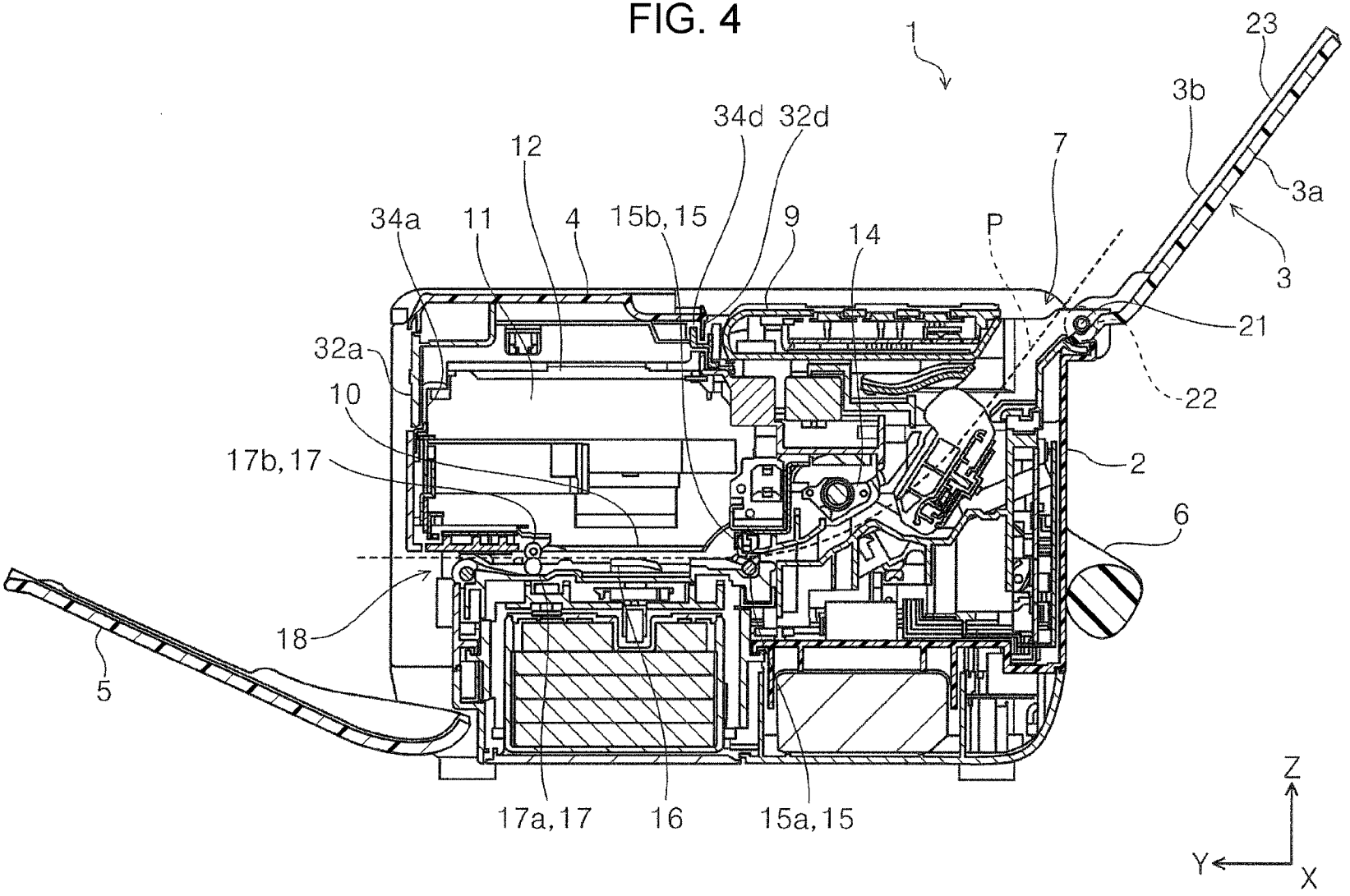
FIG. 4 is a side cross-section view illustrating a paper transport path of a printer according to the invention.
Figure 5:
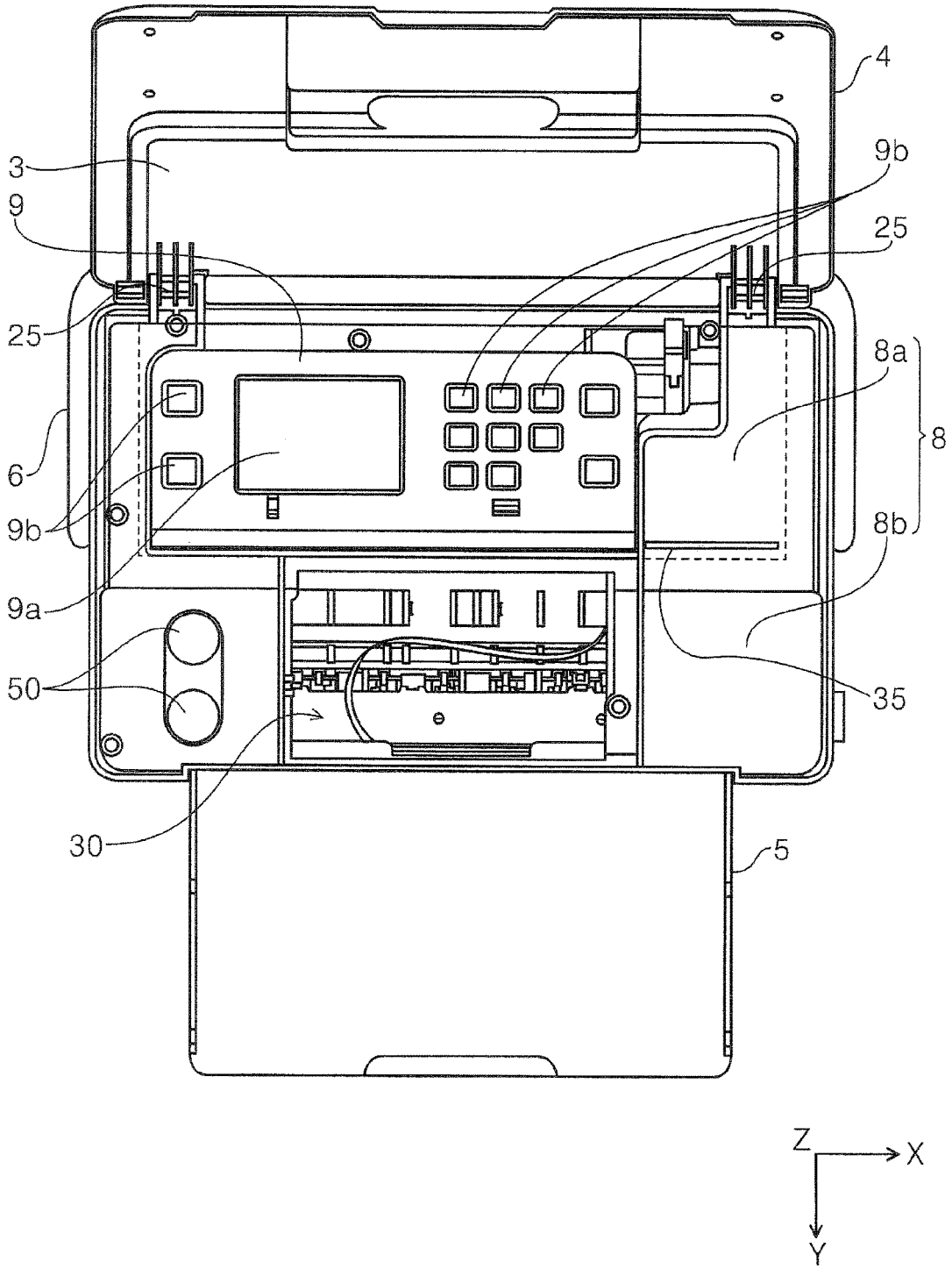
FIG. 5 is a plan view illustrating a printer according to the invention in a state in which a first upper face cover, a second upper face cover, and a paper discharge cover are open.
Figure 6:
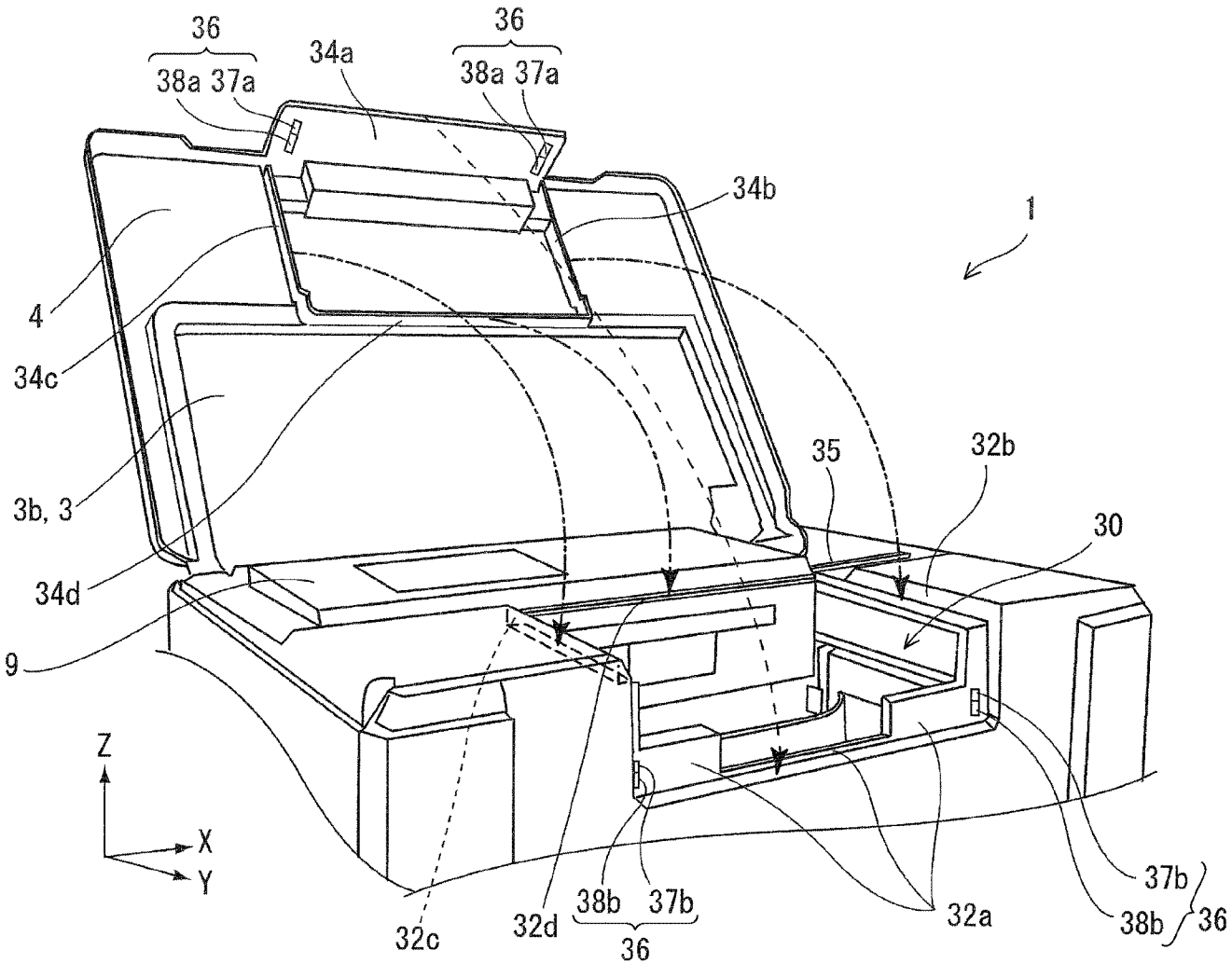
FIG. 6 is a perspective view of the printer illustrated in FIG. 2, viewed from another angle.

FIG. 1 is an exterior perspective view illustrating an example of a printer according to the invention. FIG. 2 is a perspective view illustrating the printer according to the invention in a state in which a first upper face cover, a second upper face cover, and a paper discharge cover are open. FIG. 3 is a perspective view illustrating the printer according to the invention in a state in which the first upper face cover and the paper discharge cover are open, and a panel unit is lifted up. FIG. 4 is a side cross-section view illustrating a paper transport path of the printer according to the invention. FIG. 5 is a plan view illustrating the printer according to the invention in a state in which the first upper face cover, the second upper face cover, and the paper discharge cover are open. FIG. 6 is a perspective view of the printer illustrated in FIG. 2 viewed from another angle.

Figure 7:
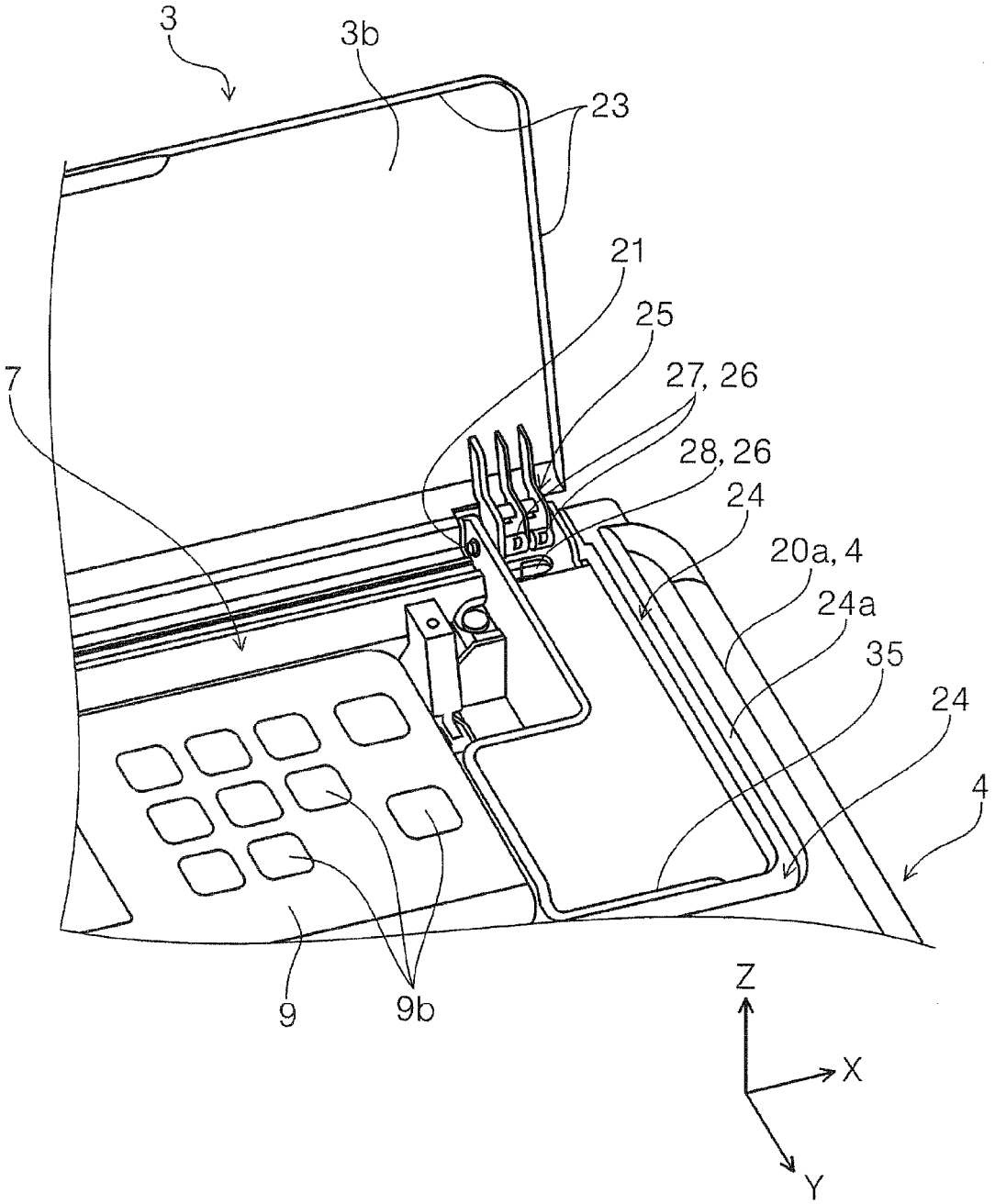
FIG. 7 is an enlarged perspective view of a right side of a printer according to the invention, viewed from an apparatus front face side.
Figure 8:
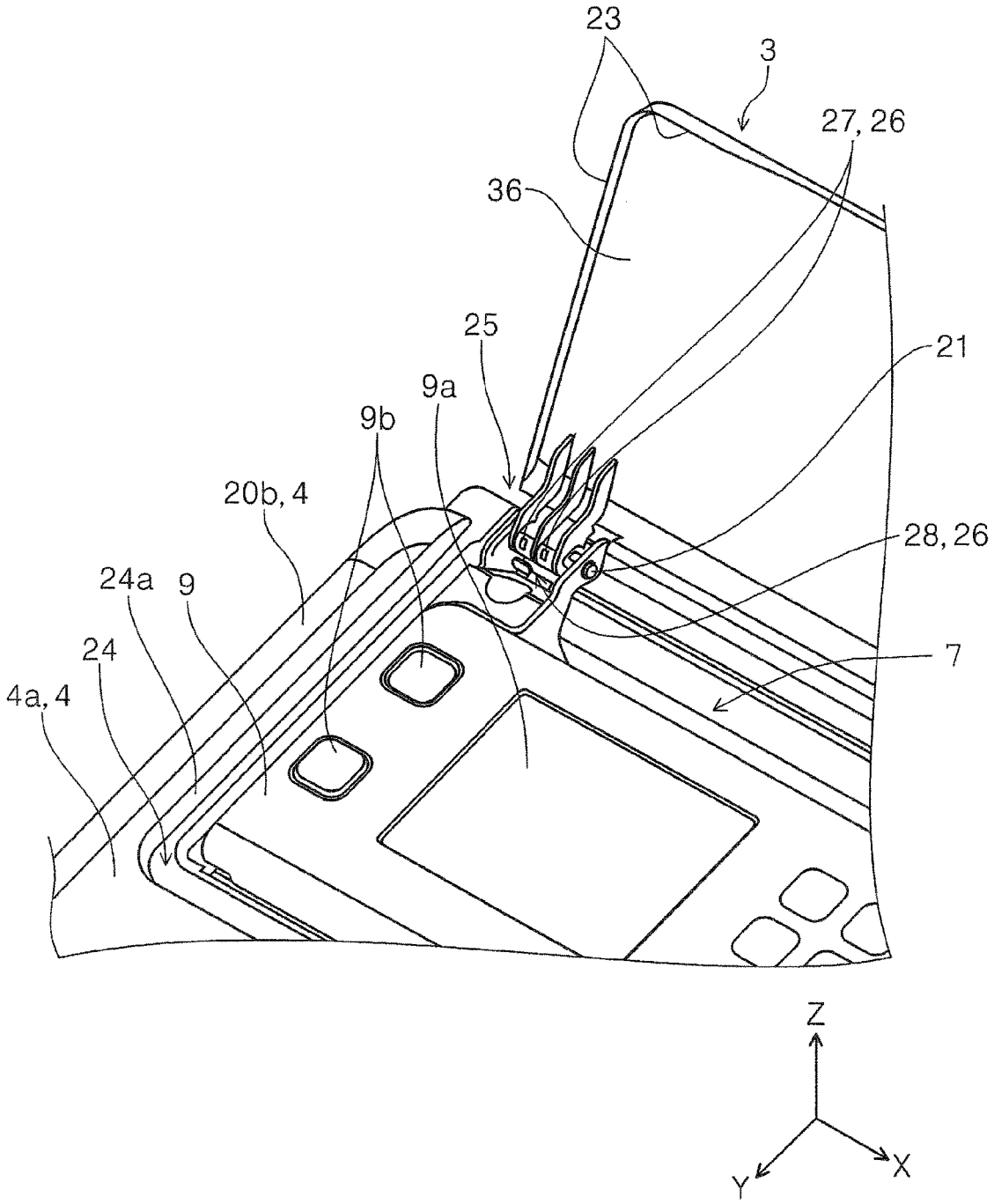
FIG. 8 is an enlarged perspective view of a left side of a printer according to the invention, viewed from an apparatus front face side.
Figure 9:
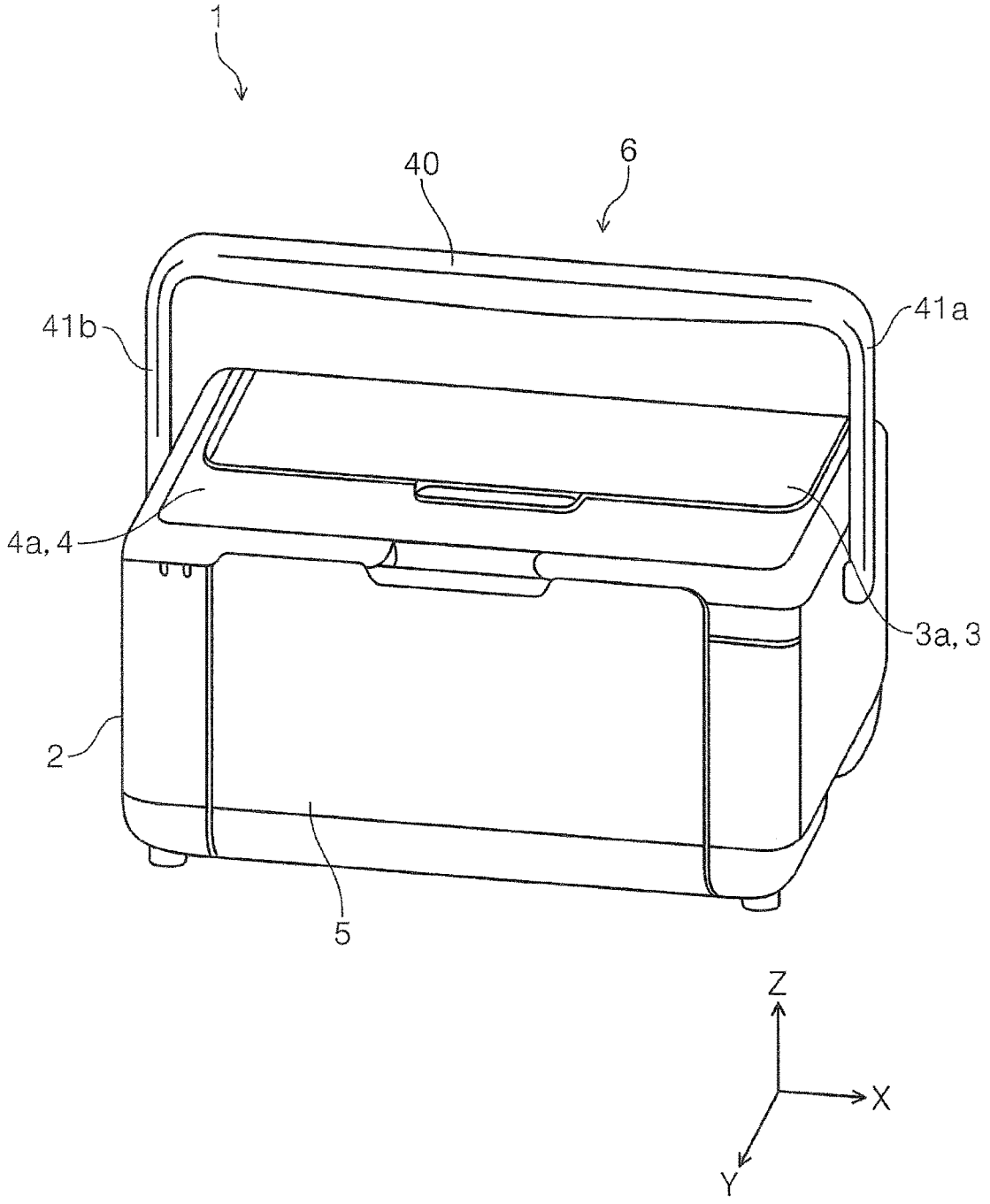
FIG. 9 is a perspective view illustrating a printer according to the invention in a state in which a handle has been rotated from a handle position illustrated in FIG. 1 toward an apparatus front face side.
Figure 10:
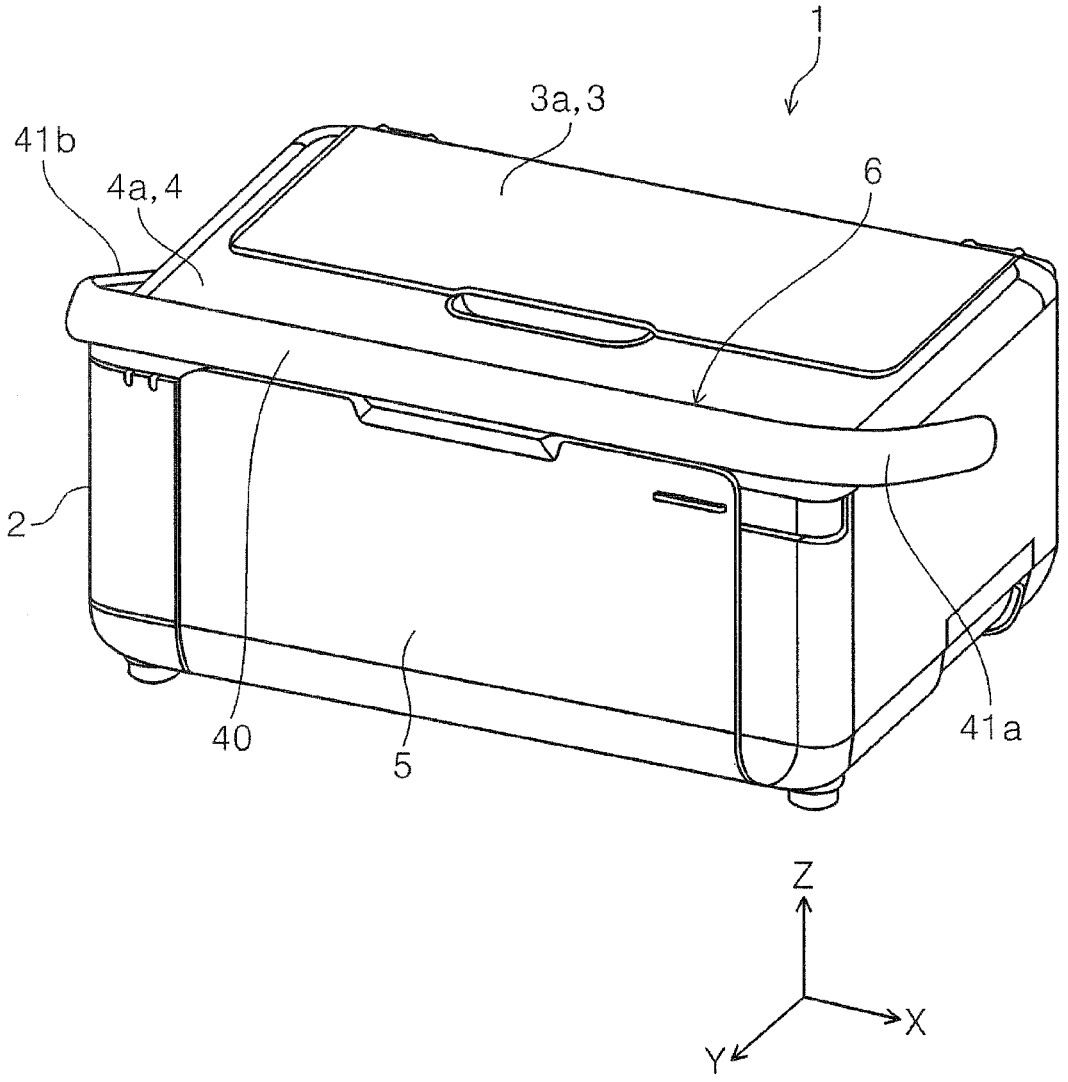
FIG. 10 is a perspective view illustrating a printer according to the invention in a state in which the handle has been further rotated from the position illustrated in FIG. 9 toward the apparatus front face side.
Figure 11:
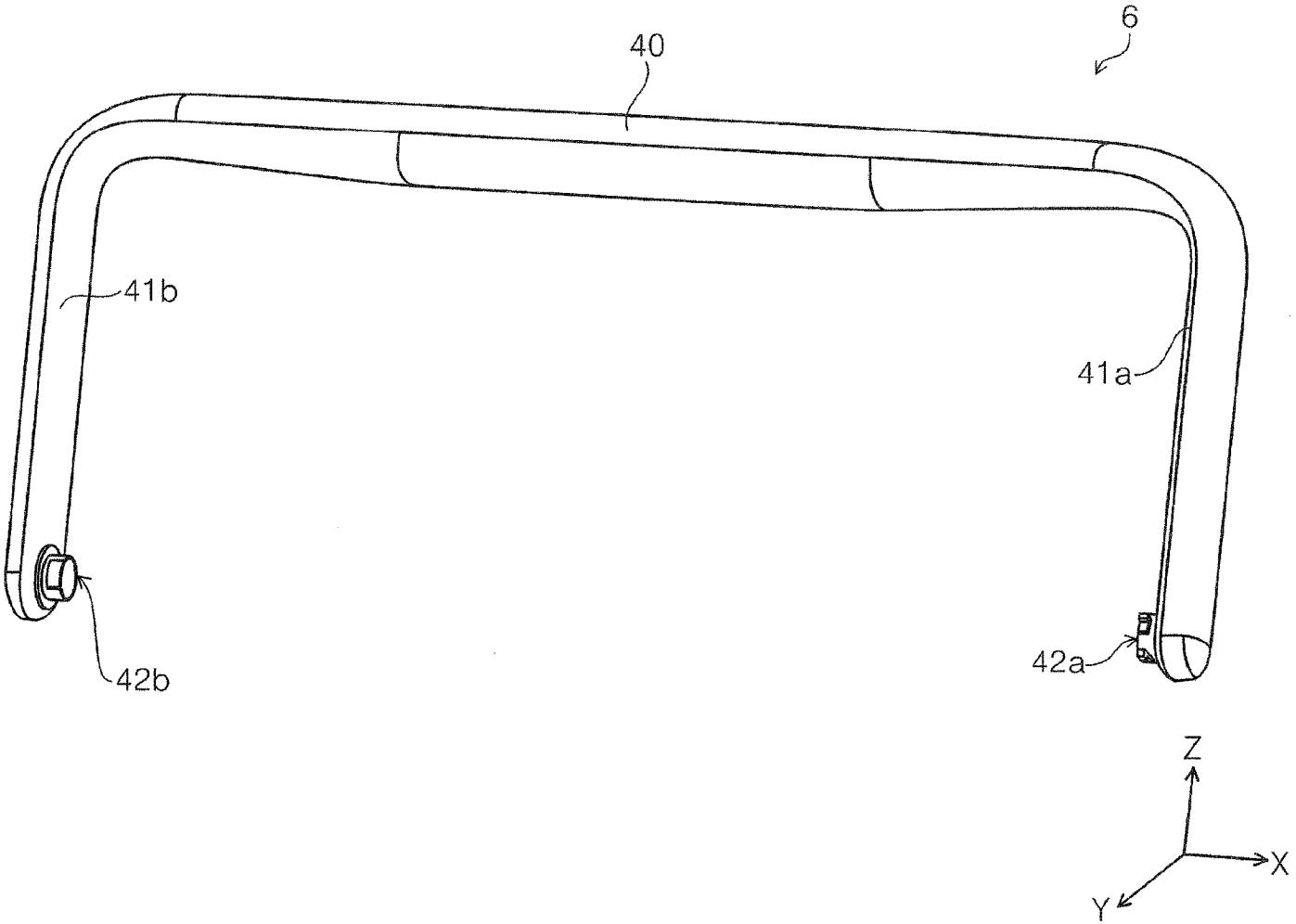
FIG. 11 is a perspective view illustrating a handle.
Figure 12:
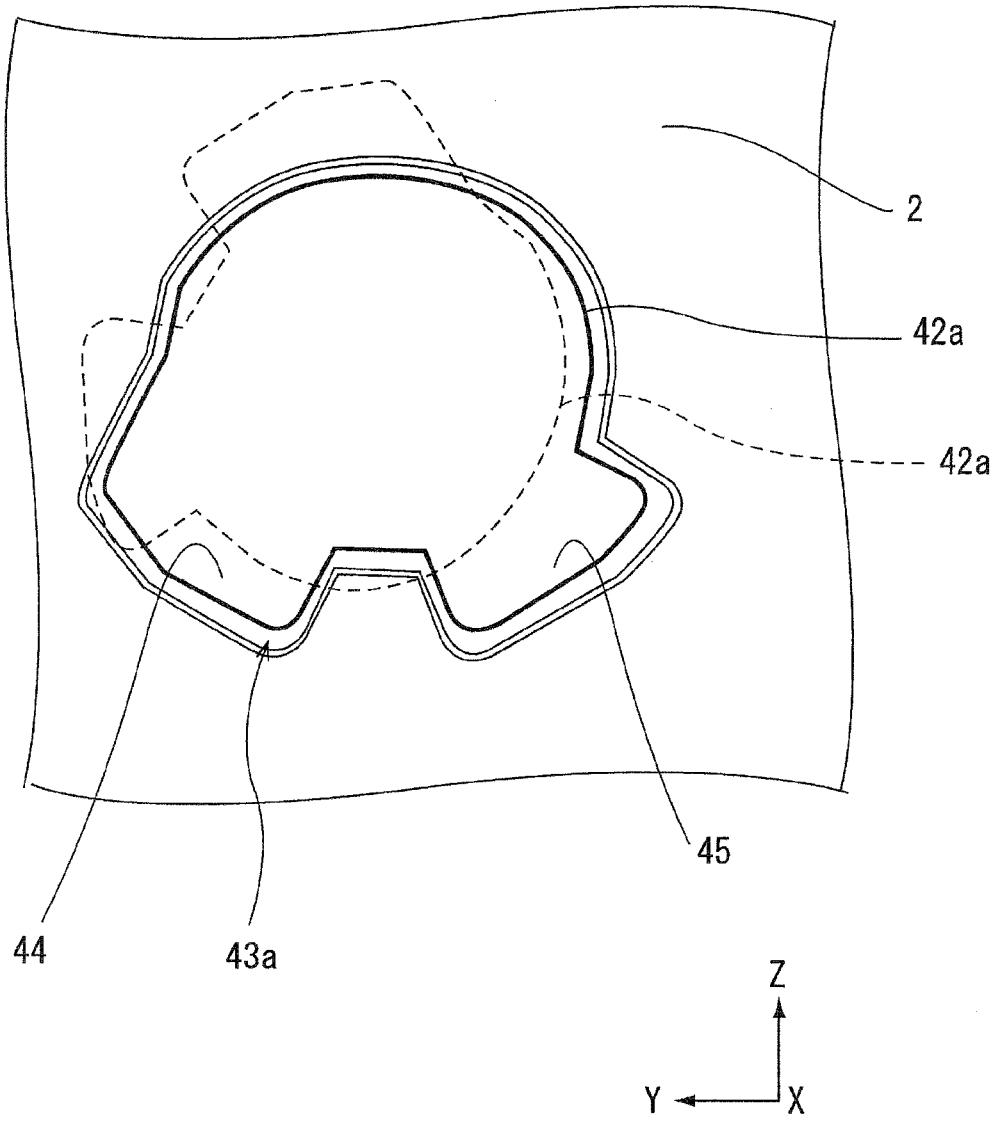
FIG. 12 is a diagram illustrating a handle attachment portion of a right side of a printer according to the invention, viewed from an apparatus front face side.
Figure 13:
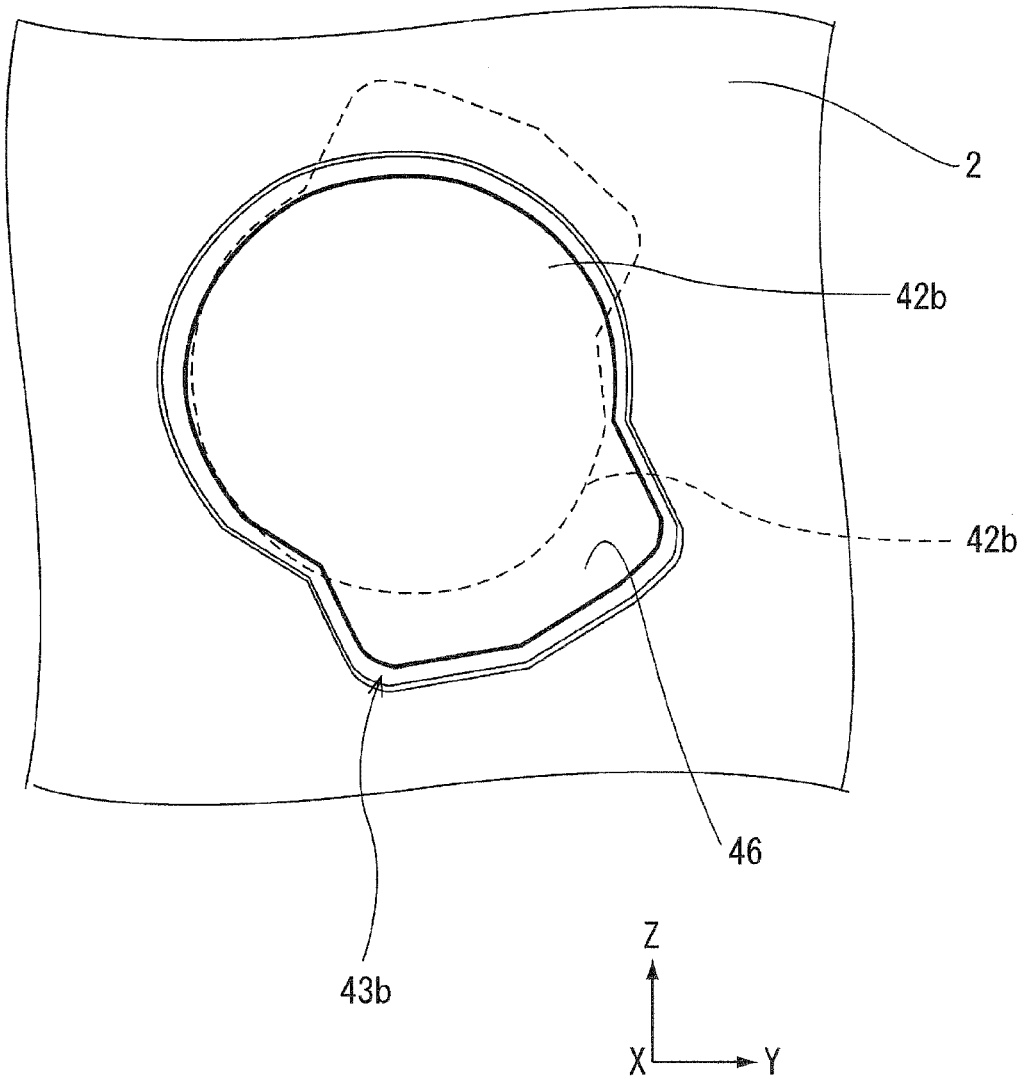
FIG. 13 is a diagram illustrating a handle attachment portion of a left side of a printer according to the invention, viewed from an apparatus front face side.
Figure 14:
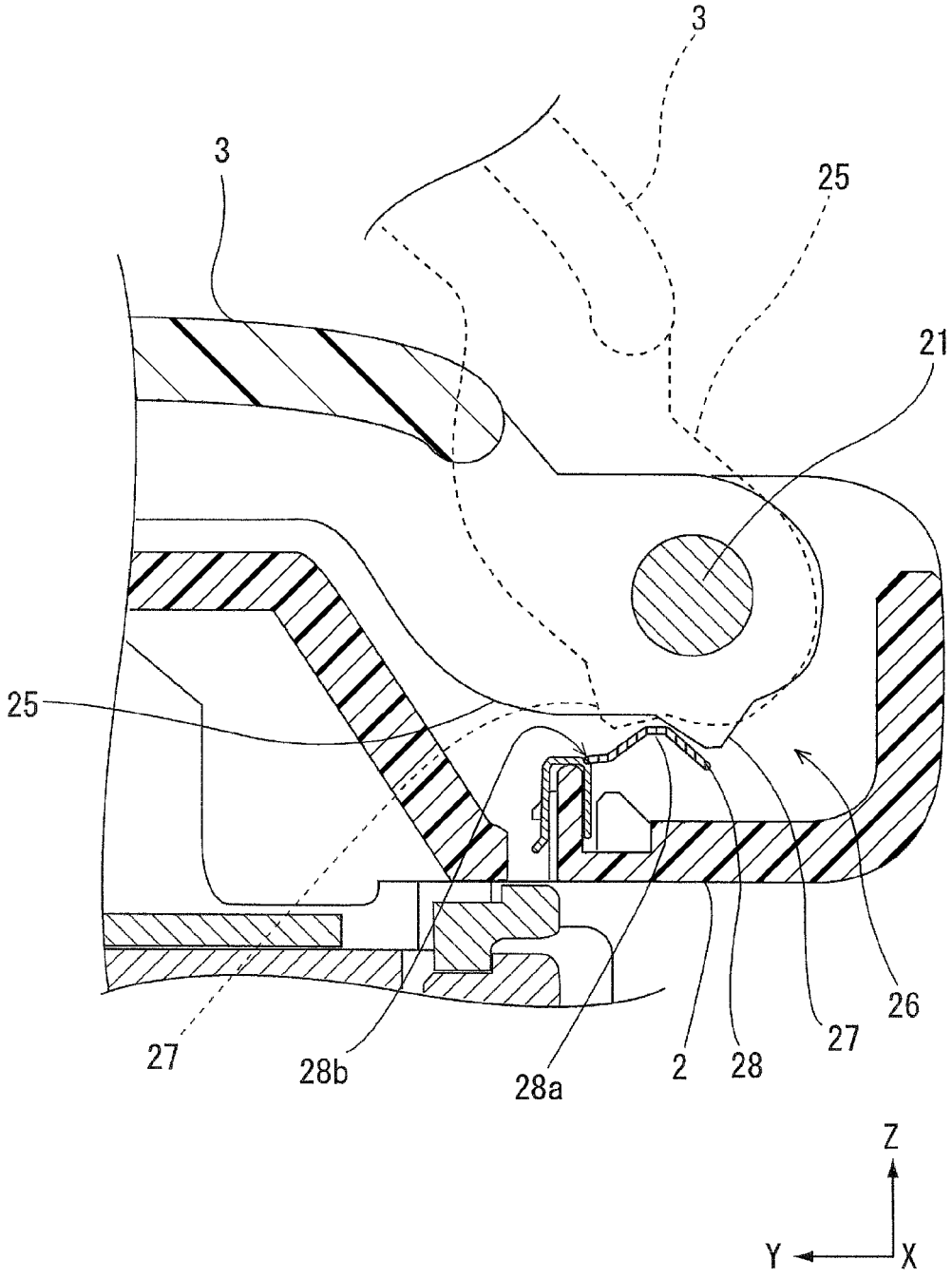
FIG. 14 is an enlarged view of relevant portions of the cross-section sectioned along XIV-XIV of FIG. 1, and is a diagram for explaining a first locking mechanism that locks a first upper face cover to a second upper face cover.
Figure 15:
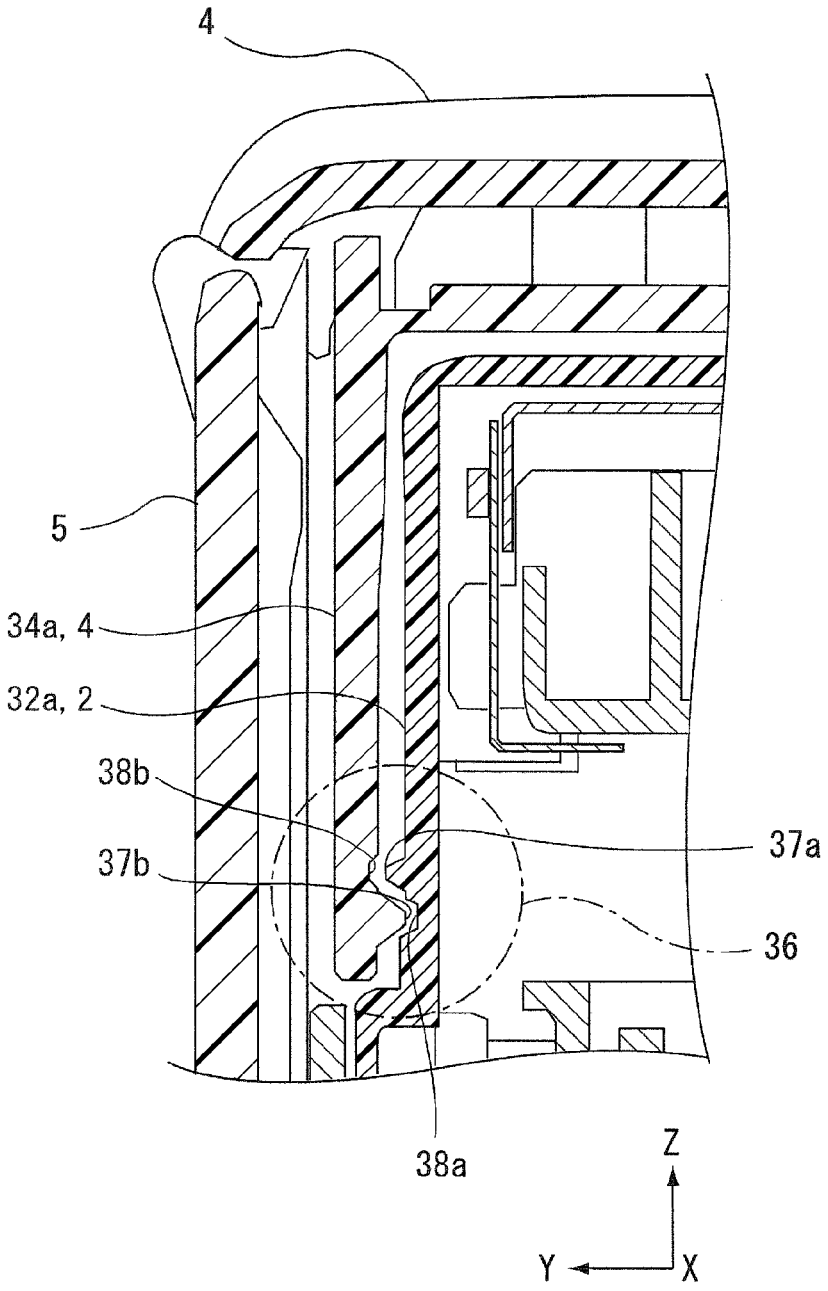
FIG. 15 is an enlarged view of relevant portions of the cross-section sectioned along XV-XV of FIG. 1, and is a diagram for explaining a second locking mechanism that locks a second upper face cover to an apparatus main body.

FIG. 7 is an enlarged perspective view of a right side of the printer according to the invention, viewed from an apparatus front face side. FIG. 8 is an enlarged perspective view of a left side of the printer according to the invention, viewed from the apparatus front face side. FIG. 9 is a perspective view illustrating the printer according to the invention in a state in which a handle has been rotated from a handle position illustrated in FIG. 1 toward the apparatus front face side. FIG. 10 is a perspective view illustrating the printer according to the invention in a state in which the handle has been further rotated from the position illustrated in FIG. 9 toward the apparatus front face side. FIG. 11 is a perspective view illustrating the handle. FIG. 12 is a diagram illustrating a handle attachment portion of the right side of the printer according to the invention, viewed from the apparatus front face side. FIG. 13 is a diagram illustrating a handle attachment portion of the left side of the printer according to the invention, viewed from the apparatus front face side. FIG. 14 is an enlarged view of relevant portions of the cross-section sectioned along XIV-XIV of FIG. 1, and is a diagram for explaining a first locking mechanism that locks the first upper face cover to the second upper face cover. FIG. 15 is an enlarged view of relevant portions of the cross-section sectioned along XV-XV of FIG. 1, and is a diagram for explaining a second locking mechanism that locks the second upper face cover to an apparatus main body.

Note that in the X-Y-Z coordinate system illustrated in each figure, the X direction is the apparatus width direction, and is also the movement direction of a recording head. Further, the Y direction represents the depth direction of the recording apparatus and the Z direction represents the apparatus height direction. Note that in each figure, the +Y direction is the direction of the apparatus front face side or front side, and the −Y direction is the direction of the apparatus rear face side or rear side. Further, the +X direction is the direction of the right side and the −X direction is the direction of the left side as viewed from the apparatus front face side. Further, the +Z direction is the direction of the apparatus upper side (including upper portions, upper faces, etc.) and the −Z direction is the direction of the apparatus lower side (including lower portions, lower faces, etc.).

Overall Configuration of Printer

An overview of the overall configuration of the printer 1 follows, with reference to FIG. 1 to FIG. 5.

The exterior of the printer 1 (FIG. 1) is configured by an apparatus main body 2 provided with an internal recording head 10 (FIG. 4) that serves as a "recording unit", described later, a first upper face cover 3 serving as a "first open/close body" and a second upper face cover 4 serving as a "second open/close body" that open and close an upper portion 8 of the apparatus main body 2 (FIG. 2), a paper discharge cover 5 that opens and closes at the front face side of the apparatus main body 2 (the side face at the +Y direction side), and a handle 6 rotatably provided for the apparatus main body 2.

The apparatus main body 2, the first upper face cover 3, the second upper face cover 4, the paper discharge cover 5, and the handle 6 can each be formed by a resin material such as plastic. The type of resin material can be changed depending on the member. Further, some members may employ a different material (such as a metal material).

The upper portion 8 of the apparatus main body 2 is provided with a setting port 7 into which paper is inserted and set as a "medium" (see FIG. 2). The first upper face cover 3 is a cover that opens and closes a region 8*a* that includes the setting port 7, in the upper portion 8 of the apparatus main body 2 (the region inside the dashed lines in FIG. 5). As illustrated in FIG. 3 and FIG. 4, the first upper face cover 3 is configured to assume an inclined orientation in the open state and to support the paper set in the setting port 7 using a supporting face 3*b*.

Further, in the present exemplary embodiment, the region 8*a* of the upper portion 8 of the apparatus main body 2 is provided with a panel unit 9 on which a liquid crystal display 9*a* that displays menus and various information such as errors, and operation buttons 9*b* are disposed as an "operation section" that receives an operation input in the printer 1. The panel unit 9 is configured such that the liquid crystal display 9*a* can be lifted up by tilting the panel unit 9 toward the front face side of the printer 1 in a state in which at least the first upper face cover 3 is open (FIG. 3).

Further, the second upper face cover 4 is configured such that, in the upper portion 8 of the apparatus main body 2, a region other than the region 8*a* that is opened and closed by the first upper face cover 3 (the region inside the dashed line of FIG. 5), namely, a region 8*b* (a region outside of the dashed line of FIG. 5), opens and closes.

Note that the configurations of the first upper face cover 3 and the second upper face cover 4 are described in more detail later.

Paper Transport Path of Printer

Next, a paper transport path in the printer 1 is described, with reference to FIG. 4. The dashed line denoted by reference sign P in FIG. 4 indicates the paper transport path. The printer 1 is configured to transport the paper in the +Y direction of FIG. 4. Note that hereafter, the paper transport direction side (+Y direction side) of the printer 1 is referred to as "downstream" and the opposite direction side (−Y direction side) is referred to as "upstream".

Inside the apparatus main body 2, a carriage 11 provided with the recording head 10 (a recording unit) that discharges ink onto paper to perform recording is provided so as to move back and forth in a direction (X axis direction) intersecting the paper transport direction (+Y direction). A bottom face of the recording head 10 is provided with a nozzle row formed from plural nozzles (not illustrated) that discharge ink onto paper being transported at the lower side of the recording head 10, and ink is supplied via the nozzles from a liquid storage unit 12 installed in the carriage 11.

The paper set in the setting port 7 is fed downstream by a paper feed roller 14.

The paper sent by the paper feed roller 14 is transported to a recording region below the recording head 10 in a state in which the paper is gripped between a pair of transport rollers 15 that includes a transporting driven roller 15*a* and a transporting following roller 15*b*.

A supporting member 16 that defines a paper gap between the paper and the bottom face of the recording head 10, this being a liquid discharge face, is provided at the side facing the recording head 10 (the lower side in FIG. 4). Recording is performed between the recording head 10 and the supporting member 16 by discharging ink from the recording head 10 onto the paper.

A discharging roller pair 17 that includes a discharging driven roller 17*a* and a discharging following roller 17*b* is provided at the downstream side of the recording head 10.

The paper after recording is transported over the supporting member 16, is sent to the downstream side by the discharging roller pair 17, is discharged from a discharge portion 18, and is placed on the paper discharge cover 5 in the open state.

The above is an outline of the internal structure of the printer 1 and the paper transport pathway.

First Upper Face Cover and Second Upper Face Cover

Next, the configurations of the first upper face cover 3 and the second upper face cover 4 are described in detail.

As described above, the first upper face cover 3 opens and closes the region 8*a* (FIG. 5), which includes the setting port 7, at the upper portion 8 of the apparatus main body 2. The second upper face cover 4 is a cover that similarly opens and closes a region 8*b*, at the upper portion 8 of the apparatus main body 2, outside of the region 8*a* opened and closed by the first upper face cover 3.

The first upper face cover 3 is formed such that the width direction of the paper set into the setting port 7, namely, the X axis direction, is a first direction, and the first upper face cover 3 is formed with a smaller dimension than the dimension of the apparatus main body 2 in the first direction. When the second upper face cover 4 is in the closed state as in FIG. 1, the first upper face cover 3 is in the closed state and contained inside the second upper face cover 4 in plan view.

Furthermore, the first upper face cover 3 and the second upper face cover 4 form a shape corresponding to the outline of the upper portion 8 of the apparatus main body 2 when both are in the closed state (FIG. 1). In other words, the entirety of the upper portion 8 of the apparatus main body 2 is covered when both the first upper face cover 3 and the second upper face cover 4 are in closed states.

The first upper face cover 3 and the second upper face cover 4 are configured to have centers of rotation at the rear side of the apparatus, and to open and close in the same direction as each other.

More specifically, the second upper face cover 4 includes an arm portion 20*a* and an arm portion 20*b* at both sides of the first upper face cover 3 in the first direction (X axis direction), and the second upper face cover 4 is rotatably joined to the apparatus main body 2 through the arm portion 20*a* and the arm portion 20*b*.

The first upper face cover 3 is provided between the arm portion 20*a* and the arm portion 20*b*, and is joined to the apparatus main body 2 so as to be rotatable, similarly to the second upper face cover 4.

In the present embodiment, as illustrated in FIG. 4, a rotation center 21 of the first upper face cover 3 and a rotation center 22 of the second upper face cover 4 are provided at the rear side of the apparatus (the −Y side) substantially collinear to each other.

Since the rotation center 21 and the rotation center 22 of the respective first upper face cover 3 and the second upper face cover 4 are at the rear side of the apparatus, and the first upper face cover 3 and the second upper face cover 4 are configured to open and close in the same direction, the first upper face cover 3 and the second upper face cover 4 can both be placed in open states (FIG. 2) while saving space. Further, the second upper face cover 4 is joined to the apparatus main body 2 through the arm portion 20*a* and the arm portion 20*b* and the first upper face cover 3 is provided therebetween, which brings a pleasing external appearance. Further, in the present embodiment, the first upper face cover 3 and the second upper face cover 4 in the closed state are formed with substantially the same shape and size as the upper portion 8 of the apparatus main body 2 in plan view, so as to have a simpler appearance.

Note that the rotation center 21 of the first upper face cover 3 and the rotation center 22 of the second upper face cover 4 need not be perfectly collinear, and could be disposed with a slight offset in the Y axis direction or the Z axis direction.

Further, as illustrated in FIG. 2, the first upper face cover 3 and the second upper face cover 4 are configured such that when the second upper face cover 4 opens, the first upper face cover 3 also opens together therewith.

More specifically, the first upper face cover 3 includes a rib 23 (FIG. 7 and FIG. 8) serving as an "engaging portion" that engages with the second upper face cover 4 such that the first upper face cover 3 also opens when the second upper face cover 4 opens.

To describe in further detail, the rib 23 of the first upper face cover 3 is provided upright along the periphery of the supporting face 3*b* of the first upper face cover 3, as illustrated in FIG. 7 and FIG. 8. A stepped portion 24 (FIG. 7 and FIG. 8) indented in an upper face 4*a* of the second upper face cover 4 is provided in the second upper face cover 4.

The rib 23 engages with the stepped portion 24 in a state in which the first upper face cover 3 is closed with respect to the second upper face cover 4 (FIG. 1 and FIG. 2), and an upper face 3*a* (the rear face of the supporting face 3*b*) of the first upper face cover 3 is placed in-plane with the upper face 4*a* of the second upper face cover 4.

When the second upper face cover 4 opens, the first upper face cover 3 opens together with the second upper face cover 4 while the rib 23 remains supported by the stepped portion 24 (FIG. 2).

Note that in the present embodiment, a first locking mechanism 26 (FIG. 14) that locks when the first upper face cover 3 is in the closed state is provided.

As illustrated in FIG. 14, the first locking mechanism 26 is configured including a projecting portions 27 provided in a hinge portion 25 of the first upper face cover 3 (see also FIG. 7 and FIG. 8) and a plate spring portion 28 provided in the apparatus main body 2. The plate spring portion 28 includes a protrusion 28*a*, and the protrusion 28*a* is elastically deformable in a vertical direction about a fulcrum portion 28*b*.

FIG. 14 illustrates the first upper face cover 3 in the closed state by a solid line, and illustrates the first upper face cover 3 in the open state by a dashed line.

In a state in which the first upper face cover 3 is open with respect to the second upper face cover 4 (the first upper face cover 3 of the dashed line in FIG. 14; referred to as the open state hereafter), the projecting portions 27 are positioned further to the +Y side than the protrusion 28*a* of the plate spring portion 28. When the first upper face cover 3 closes with respect to the second upper face cover 4, namely, when the first upper face cover 3 rotates counterclockwise in plan view of FIG. 14 with the rotation center 21 serving as the axis, the projecting portions 27 also rotate in the counterclockwise direction with the rotation center 21 serving as the axis. When this occurs, the projecting portions 27 overcome the protrusion 28*a* while pushing down the plate spring portion 28, and in a state in which the first upper face cover 3 is closed with respect to the second upper face cover 4 (the first upper face cover 3 of the solid line in FIG. 14; referred to as the closed state hereafter), the projecting portions 27 are positioned further to the −Y side than the protrusion 28*a*.

When the first upper face cover 3 is thus placed in the closed state, the protrusion 28*a* of the plate spring portion 28 restricts the rotation of the projecting portions 27 in the direction that opens the second upper face cover 4, thereby locking the first upper face cover 3 to the apparatus main body 2.

In the state in which the first upper face cover 3 is locked with respect to the apparatus main body 2, the second upper face cover 4, which engages with the first upper face cover 3, is kept in the closed state with respect to the apparatus main body 2. Accordingly, the first upper face cover 3 and the second upper face cover 4 will not open unexpectedly when, for example, the printer 1 is tilted or turned upside-down while being carried.

Note that in order to more securely lock the second upper face cover 4 to the apparatus main body 2, a second locking mechanism 36 (FIG. 6 and FIG. 15) is provided serving as a dedicated locking mechanism for locking the second upper face cover 4 to the apparatus main body 2. This is described in more detail later.

Further, the first upper face cover 3 is configured so as to be capable of independently opening and closing by releasing the locked state of the first locking mechanism 26 when the second upper face cover 4 is in the closed state. Accordingly, when the setting port 7 is used, namely, when the printer 1 is in use, only the first upper face cover 3 can be opened.

Releasing the first locking mechanism 26 from the locked state can be performed by, for example, applying an external force to the first upper face cover 3 in the direction of opening (in plan view of FIG. 14, rotating the first upper face cover 3 clockwise with the rotation center 21 serving as an axis). Accordingly, as the first upper face cover 3 rotates, the projecting portions 27, which are positioned at the −Y side of the protrusion 28*a* in the closed state, overcome the protrusion 28*a* while pushing down the plate spring portion 28 and rotates to a position at the +Y side, and the locked state of the first locking mechanism 26 is released.

Further, in the present embodiment, although the engaging portion (rib 23) of the first upper face cover 3 to the second upper face cover 4 is not locked to the second upper face cover 4, the rib 23 of the first upper face cover 3 can be provided with a separate locking mechanism that locks to the second upper face cover 4.

Note that in the present embodiment when the first upper face cover 3 is not locked to the second upper face cover 4, if the second upper face cover 4 is gripped and opened by hand from the state in which both the first upper face cover 3 and the second upper face cover 4 are closed, when the open angle of the second upper face cover 4 increases beyond 90°, the rib 23 of the first upper face cover 3 separates from the stepped portion 24 of the second upper face cover 4 due to gravity and, at first, only the first upper face cover 3 adopts a completely open state in some cases. However, if the second upper face cover 4 is also opened as far as the completely open state, the rib 23 of the first upper face cover 3 contacts and re-engages with the stepped portion 24 of the second upper face cover 4 and the upper face 3*a* of the first upper face cover 3 can be placed in a state of being in-plane with the upper face 4*a* of the second upper face cover 4.

Further, if the second upper face cover 4 is gripped and closed by hand, only the second upper face cover 4 closes, such that the first upper face cover 3 remains in the completely open state.

The printer 1 is provided with the first upper face cover 3 and the second upper face cover 4 configured as described above, and therefore has the following operation and advantageous effects. Namely, the first upper face cover 3 and the second upper face cover 4 can both be closed to cover the entirety of the upper portion 8 of the apparatus main body 2 when the printer 1 is not in use, and when the printer 1 is in use (during recording), only the first upper face cover 3 opens as illustrated in FIG. 3, enabling the region 8*a* of the upper portion 8 of the apparatus main body 2, which includes the setting port 7, to be exposed. Namely, since only a portion of the upper portion 8 of the apparatus main body 2 is exposed when the printer 1 is in use, dust and the like can be suppressed from entering the interior of the apparatus main body 2 during use.

Further, in the present embodiment, the panel unit 9 is provided in the region 8*a*, which is opened and closed by the first upper face cover 3, and the panel unit 9 is revealed together with the setting port 7 due to the first upper face cover 3 opening. Accordingly, settings and the like when recording can also be set in the state in which only the first upper face cover 3 is open.

Further, an opening portion 30 is provided in the upper portion 8 of the apparatus main body 2, and when the second upper face cover 4 is open, the interior of the apparatus main body 2 is visible through the opening portion 30 and a movement region of the carriage 11 provided with the recording head 10 is revealed.

In configurations such as those of related technology in which the entirety of the upper portion 8 of the apparatus main body 2, including the setting port 7, is opened and closed by a single open/close body (an upper face cover), there has been a need to cover using an opening/closing cover other than the opening portion 30 that uncovers the movement region of the carriage 11, since the entirety of the upper portion 8 of the apparatus main body 2 is placed in an exposed state when the printer 1 is in use (during recording). Note that the movement region of the carriage 11 is uncovered when, for example, performing maintenance such as exchanging the ink tank installed in the carriage 11.

When the printer 1 according to the invention is in use, the setting port 7 and the panel unit 9 are revealed simply by opening the first upper face cover 3, and there is no need to open the second upper face cover 4. Accordingly, the opening portion 30, which reveals the movement region of the carriage 11 when uncovered, is configured to be opened and closed by the second upper face cover 4, enabling the number of components to be reduced.

Next, other configuration for suppressing entry of dust and the like into the interior of the apparatus main body 2 in the printer 1 is described.

First, the rib 23 of the first upper face cover 3 is configured such that at least a portion of the rib 23 overlaps with the second upper face cover 4 in the apparatus height direction (Z axis direction).

More specifically, although the rib 23 is upright along the periphery of the supporting face 3*b* of the first upper face cover 3 (FIG. 7 and FIG. 8) in a state in which the first upper face cover 3 is closed with respect to the second upper face cover 4 (FIG. 1 and FIG. 2), the rib 23 overlaps in the apparatus height direction with a wall section 24*a* of the stepped portion 24 (FIG. 7 and FIG. 8), which is provided in a state of being indented beyond the upper face 4*a* of the second upper face cover 4.

The rib 23 of the first upper face cover 3 and the wall section 24*a* of the stepped portion 24 provided in the second upper face cover 4 overlap each other in the apparatus height direction, thereby enabling dust, liquid droplets, and the like to be suppressed from entering between the opening and closing first upper face cover 3 and second upper face cover 4.

Further, a main body side rib 35 (see FIG. 5 and FIG. 6) that seals a gap between the closed apparatus main body 2 and second upper face cover 4 can be provided in the upper portion 8 of the apparatus main body 2. In the present embodiment, as illustrated in FIG. 5, the main body side rib 35 is provided on the upper portion 8 of the apparatus main body 2, at a position at the +X side of the panel unit 9, this position being an end of the region 8*a* that is opened and closed by the first upper face cover 3, namely, the vicinity of a boundary between the region 8*a* and the region 8*b*. Concerns regarding entry of dust, liquid droplets, or the like from between the closed second upper face cover 4 and apparatus main body 2 can be alleviated by the main body side rib 35.

The position where the main body side rib 35 is provided is not limited to the position in FIG. 5; for example, the main body side rib 35 can be provided so as to follow the short edge of the region 8*a* in FIG. 5.

Further, the second upper face cover 4 is provided with cover side wall sections 34*a*, 34*b*, 34*c*, and 34*d* (see each in FIG. 6) in positions facing the periphery of the opening portion 30 when the closed.

The cover side wall sections 34*a*, 34*b*, 34*c*, and 34*d* of the second upper face cover 4 are configured such that at least a portion of each overlaps with the apparatus main body 2 in the apparatus height direction.

More specifically, the apparatus main body 2 is provided with main body side wall sections 32*a*, 32*b*, 32*c*, and 32*d* at the periphery of the opening portion 30, and in a state in which the second upper face cover 4 is closed, the cover side wall sections 34*a*, 34*b*, 34*c*, and 34*d* provided in the second upper face cover 4 and the main body side wall sections 32*a*, 32*b*, 32*c*, and 32*d* provided in the apparatus main body 2 overlap each other in the apparatus height direction.

In FIG. 4, the portion where the second upper face cover 4 side overlaps with the apparatus main body 2 side in the height direction is provided at the periphery of the opening portion 30, such that the cover side wall section 34*a* overlaps with the main body side wall section 32*a* and the cover side wall section 34*d* overlaps with the main body side wall section 32*d*, thereby enabling a reduction in concerns regarding entry of dust, liquid droplets, or the like into the interior of the apparatus main body 2 through the periphery of the opening portion 30.

Other Configuration of Printer

Locking Mechanism that Locks Second Upper Face Cover to Apparatus Main Body

The second locking mechanism 36 that locks the second upper face cover 4 to the apparatus main body 2 (FIG. 6 and FIG. 15) is provided in the printer 1 of the present embodiment.

As illustrated in FIG. 6 and FIG. 15, the second locking mechanism 36 includes engagement protrusions 37*a* and engagement indentations 38*a* that are provided in the cover side wall sections 34*a* at the apparatus front face side of the second upper face cover 4, and engagement protrusions 37*b* and engagement indentations 38*b* that are provided in the main body side wall sections 32*a*, which overlap with the cover side wall sections 34*a* in the height direction when the second upper face cover 4 is closed.

In the cover side wall sections 34*a*, the engagement protrusions 37*a* and the engagement indentations 38*a* form pairs provided at both apparatus width direction (X axis direction) sides as illustrated in FIG. 6. Similarly, in the main body side wall sections 32*a*, the engagement protrusions 37*b* and the engagement indentations 38*b* also form pairs provided at both apparatus width direction (X axis direction) sides (FIG. 6).

As illustrated in FIG. 15, in the state in which the second upper face cover 4 is closed with respect to the apparatus main body 2, the engagement protrusions 37*a* of the cover side wall sections 34*a* engage with the engagement indentations 38*b* of the main body side wall sections 32*a* and the engagement indentations 38*a* of the cover side wall sections 34*a* engage with the engagement protrusions 37*b* of the main body side wall sections 32*a*. This locks the closed second upper face cover 4 to the apparatus main body 2.

Second Upper Face Cover

In the present embodiment, as illustrated in FIG. 9, the handle 6, which serves as a handle to be gripped when carrying the printer 1, is provided with a grip 40 extending in the apparatus width direction, and an extension 41*a* and an extension 41*b* that are provided at either end of the grip 40. The handle 6 is able to rotate from a position at which the grip 40 (not illustrated in FIG. 1 or FIG. 3) is at the rear face side as illustrated in FIG. 1 and FIG. 3 to a position where the grip 40 is at the front face side as illustrated in FIG. 10. When the printer 1 is in use, the handle 6 is normally in the state of FIG. 3. When the handle 6 is held, the handle 6 adopts a state in which the grip 40 is positioned substantially directly above a top face (+Z side face) of the printer 1 as illustrated in FIG. 9.

Here, in the present embodiment, the handle 6 is configured capable of detaching from the apparatus main body 2.

The handle 6 (FIG. 11) is provided with an attachment portion 42*a* and an attachment portion 42*b* at end portions of the extension 41*a* and the extension 41*b*, respectively. The attachment portion 42*a* and the attachment portion 42*b* of the handle 6 respectively engage with a hole portion 43*a* (FIG. 12) provided at a +X side face in the X axis direction of the apparatus main body 2 and a hole portion 43*b* (FIG. 13) provided at a −X side face, thereby attaching the handle 6 to the apparatus main body 2 as a unit.

The attachment portion 42*a* and the attachment portion 42*b* are formed in a shape that is asymmetrical as viewed along both X axis directions (see FIG. 12 for the attachment portion 42*a* and FIG. 13 for the attachment portion 42*b*). Further, the attachment portion 42*a* and the attachment portion 42*b* are formed with different shapes as viewed along the X axis direction.

In the present embodiment, the shape of the attachment portion 42*a* in plan view along the X axis direction is formed into a shape that is an ellipse provided with two protrusions (a first protrusion 44 and a second protrusion 45), as illustrated in FIG. 12. Further, the shape of the attachment portion 42*b* in plan view in the X axis direction is formed in a shape that is an ellipse provided with one protrusion 46, as illustrated in FIG. 13.

The hole portion 43*a* into which the attachment portion 42*a* is inserted (FIG. 12) is shaped to correspond to the shape of the attachment portion 42*a*, the hole portion 43*b* into which the attachment portion 42*b* is inserted (FIG. 13) is shaped to correspond to the shape of the attachment portion 42*b*.

Attachment/detachment of the handle 6 to/from the apparatus main body 2 is performed with the handle 6 in the state of FIG. 10.

In a state in which the grip 40 is positioned at the apparatus front face side (FIG. 10), the attachment portion 42*a* and the attachment portion 42*b* of the handle 6 are oriented so as to be insertable into or removable from the hole portion 43*a* and the hole portion 43*b*, as illustrated by the solid lines in FIG. 12 and FIG. 13. When the handle 6 rotates from the state of FIG. 10 in the direction that moves the grip 40 toward the rear face side, the attachment portion 42*a* and the attachment portion 42*b* rotate as illustrated by the dashed line in FIG. 12 and FIG. 13 and become oriented so as to not be removable from the hole portion 43*a* and the hole portion 43*b*.

Thus, attachment/detachment of the handle 6 to/from the apparatus main body 2 is performed in a state in which the grip 40 is positioned at the apparatus front face side (FIG. 10), and thus the handle 6 is securely attached to the apparatus main body 2 when the handle 6 is carried (the state of FIG. 9) or when the printer 1 is in use (the state of FIG. 3).

Further, the attachment portion 42*a* at the +X side and the attachment portion 42*b* at the −X side have different shapes from each other, enabling the attachment direction of the handle 6 to be made clear.

Note that the printer 1 can be employed in a state in which the handle 6 has been removed from the apparatus main body 2. In such an event, the hole portion 43*a* (FIG. 12) and the hole portion 43*b* (FIG. 13) provided at the +X side face and the −X side face of the apparatus main body 2 can be covered and sealed by respective non-illustrated caps.

Further, the printer 1 cap be provided with cap storage indentations 50 for storing the caps (FIG. 2 and FIG. 5). In the present embodiment, the cap storage indentations 50 are provided in the region 8*b* in the upper portion 8 of the apparatus main body 2, which is opened and closed by the second upper face cover 4.

The caps for sealing the hole portion 43*a* and the hole portion 43*b* are removed when the handle 6 is attached to the apparatus main body 2. The concern of misplacing the caps is reduced since the two removed caps can be stored in the cap storage indentations 50.

Further, since the cap storage indentations 50 are provided in the region 8*b* in the upper portion 8 of the apparatus main body 2 so as to be opened and closed by the second upper face cover 4, the external appearance is made pleasing without ordinarily exposing the cap storage indentations 50 to the exterior, in addition to further reducing the concern of misplacing the caps stored in the cap storage indentations 50.

Note that the invention is not limited to the embodiment above. Various modifications are possible within the scope of the invention as described by the scope of the claims, and it goes without saying that these are also included in the scope of the invention.

The entire disclosure of Japanese Patent Application No. 2016-194214, filed Sep. 30, 2016 is expressly incorporated by reference herein.

What is claimed is:

1. A recording apparatus comprising:

a setting port in which a medium is set for feeding, the setting port being provided in an upper portion of an apparatus main body including a recording unit that performs recording on a medium;

a first open/close body that opens and closes a region of the upper portion of the apparatus main body, the region including the setting port; and a second open/close body that opens and closes a region of the upper portion of the apparatus main body other than the region opened and closed by the first open/close body, the first open/close body being formed such that when a medium is set in the setting port, the width direction of the medium is a first direction, and the first open/close body has a smaller dimension in the first direction than a dimension of the apparatus main body in the first direction, the first open/close body in a closed state being included inside the second open/close body in plan view when the second open/close body is in a closed state, the first open/close body and the second open/close body both in the closed states forming a shape that corresponds to an outline of the upper portion of the apparatus main body, the first open/close body and the second open/close body each have separate centers of rotation, with those separate centers of rotation being disposed at an apparatus rear side and open and close in the same direction; and the second open/close body comprising a first and second arm portions, wherein:

each of the first and second arm portions is disposed at a side of the first open/close body, and each of the first and second arm portions is rotatably connected to the apparatus main body via the corresponding center of rotation.

2. The recording apparatus according to claim 1, wherein:

the first open/close body includes an engaging portion that engages with the second open/close body, the engaging portion being configured to open the first open/close body when the second open/close body is being opened.

3. The recording apparatus according to claim 2, wherein at least a portion of the engaging portion overlaps with the second open/close body in an apparatus height direction.

4. The recording apparatus according to claim 2, wherein the first open/close body is configured to be independently openable and closable when the second open/close body is in the closed state.

5. The recording apparatus according to claim 4, wherein the first open/close body in an open state adopts an inclined orientation and supports a medium to be set in the setting port.

6. The recording apparatus according to claim 5, wherein the second open/close body includes arm portions at both sides of the first open/close body in the first direction, and is rotatably joined to the apparatus main body through the arm portions.

7. The recording apparatus according to claim 1, wherein an operation section that receives an operation input is revealed together with the setting port by opening the first open/close body.

8. The recording apparatus according to claim 1, wherein the apparatus main body includes an opening portion through which a movement region of a carriage provided with the recording unit is revealed by opening the second open/close body.

9. The recording apparatus according to claim 8, wherein the second open/close body includes a wall section and at least a portion of the wall section overlaps with the apparatus main body in the apparatus height direction.

10. The recording apparatus according to claim 1, wherein the centers of rotation are provided at the rear side of the apparatus substantially collinear to each other.

11. A recording apparatus comprising:

a setting port in which a medium is set for feeding, the setting port being provided in an upper portion of an apparatus main body including a recording unit that performs recording on a medium;

a first open/close body that opens and closes a region of the upper portion of the apparatus main body, the region including the setting port; and a second open/close body that opens and closes a region of the upper portion of the apparatus main body other than the region opened and closed by the first open/close body, the first open/close body being formed such that when a medium is set in the setting port, the width direction of the medium is a first direction, and the first open/close body has a smaller dimension in the first direction than a dimension of the apparatus main body in the first direction, the first open/close body in a closed state being included inside the second open/close body in plan view when the second open/close body is in a closed state, the first open/close body and the second open/close body both in the closed states forming a shape that corresponds to an outline of the upper portion of the apparatus main body, and the first open/close body and the second open/close body each have separate centers of rotation, with those separate centers of rotation being disposed at an apparatus rear side and open and close in the same direction; and the first open/close body includes an engaging portion that engages with the second open/close body, the engaging portion being configured to open the first open/close body when the second open/close body is being opened, wherein an operation section that receives an operation input is revealed together with the setting port by opening the first open/close body.

* * * * *